US005183427A

United States Patent [19]

Draper

[11] Patent Number: 5,183,427

[45] Date of Patent: Feb. 2, 1993

[54] COLLAPSIBLE TOY BUILDING

[76] Inventor: A. Allen Draper, 3860 S. Midland, Roy, Utah 84067

[21] Appl. No.: 885,832

[22] Filed: May 20, 1992

[51] Int. Cl.[5] ..... A63H 33/00; F41J 5/00

[52] U.S. Cl. ..... 446/4; 446/478; 446/490; 273/383; 273/391

[58] Field of Search ..... 446/4, 6, 490, 478, 446/487, 368, 476; 273/380, 383, 385, 391, 386, 387

[56] References Cited

U.S. PATENT DOCUMENTS

| | | | |
|---|---|---|---|
| 276,539 | 4/1883 | Reed | 446/4 |
| 1,266,494 | 5/1918 | Lakin | 273/383 |
| 2,955,381 | 10/1960 | Joslyn | 446/4 |
| 4,236,711 | 12/1980 | Klingbeil | 446/368 X |
| 4,488,373 | 12/1984 | Glickson et al. | 446/4 |
| 4,867,723 | 9/1989 | Ashbach | 446/4 |
| 4,979,926 | 12/1990 | Bisceglia | 446/476 |

*Primary Examiner*—Mickey Yu
*Attorney, Agent, or Firm*—A. Ray Osburn

[57] ABSTRACT

A toy collapsible house. A column of stacked segments supports the house, held together by a spring tensioned cord, impact triggered release of which slides stiff cord portions away from segment junctions, allowing column and house collapse. The column cord is lifted from above the roof to reassemble the house.

6 Claims, 5 Drawing Sheets

COLLAPSIBLE TOY BUILDING

BACKGROUND OF THE INVENTION

1. Field

The field of the invention is toy structures comprising multiple parts assembled together into an upstanding, stable structure, which is however adapted to come apart in response to a triggering action.

2. State of the Art

The prior art includes many structures made up of co-operating units, such as blocks, simulated logs, and the like. While the majority of these prior structures can be disassembled piece by piece, some are designed to fly apart dramatically upon actuation of a triggering mechanism. Among these is an "exploding" structure disclosed in U.S. Pat. No. 276,539. The roof is spring loaded to fly apart upon impact of a toy cannon pellet upon a triggering button. U.S. Pat. No. 4,979,926 discloses a bridge structure with component parts assembled in cooperation with a spring powered plunger which is released by depression of a triggering button, resulting in forceful, rapid, disassembly of the parts. Similarly, U.S. Pat. No. 4,867,723 discloses an "explodable shack". Again, the components of the structure are assembled along with a pivoted spring loaded member in this case utilized as the floor of the shack, so that the weight of an entering toy vehicle triggers instant disassembly of the shack into airborne component parts. U.S. Pat. No. 4,488,373 discloses a play set having a single column of stacked-together blocks upon a base, into which is incorporated a lever mechanism for tipping the column to fall in dramatic disassembled disarray. The blocks are connected in order of stacking assembly by a loose flexible cord running from the top member through a central hole through each. The individual blocks include recesses and mating projections to assure stability of the stacked column, but each block must be individually handled in reassembly. All of the more elaborate prior art structures additionally require gathering and reorganizing chaotically scattered parts for reassembly, frustrating to some children and beyond the capabilities of others. Adult help is often required.

A need therefore remains for a collapsible toy structure which may be rapidly reassembled for repeated use by young children, without reorganizing and/or handling of its component parts.

BRIEF SUMMARY OF THE INVENTION

The disadvantages and shortcomings of the prior art are eliminated or substantially alleviated by the present invention, which provides a toy building with a column comprising separate, axially bored, segments strung upon a generally flexible, spring-tensioned cord having a stiffened portion spanning each segment-to-segment junction, rendering the column assembly rigid and stable to support the roof, and the walls hanging from the roof. Each wall is made up of planks each bored vertically for suspending cords attached to eaves or gables and anchored to a lowermost plate serving as a base and floor. An impact-actuated trigger mechanism releases the column cord to be pulled downward by the tensioning spring, shifting the stiffened portions from the segment junctions, leading to immediate column and building collapse. Column segments, wall planks, floor plate and roof all remain strung together in original order.

The upper end of the cord may be lifted from above the roof. Preferably, the column cord extends through the roof to be manually grasped. Lifting the cord raises the collapsed structure, causing the cord to align the column segments, and its weight compressing the cord tensioning spring. This causes the cord to shift upwardly to reposition the stiffening sleeves across the column segment junctions, and to re-attach the cord to the release mechanism. The structure is thus reassembled with all parts in original order, ready for immediate reuse.

The impact-releasable mechanism preferably comprises a pair of hooks hanging pivoted from the roof to engage a button secured to the cord. Impact upon a plate provided above the roof forces a plunger downward to dislodge the hooks from the button.

The principal object of the invention is therefore to provide a toy building collapsed by impact of a toy projectile and capable of immediate reassembly by small children for reuse without delay, and without gathering or assembly of components individually.

BRIEF DESCRIPTION OF THE DRAWINGS

In the drawings, which represent the best mode presently contemplated for carrying out the invention.

DETAILED DESCRIPTION OF ILLUSTRATED EMBODIMENTS

Figure 1:
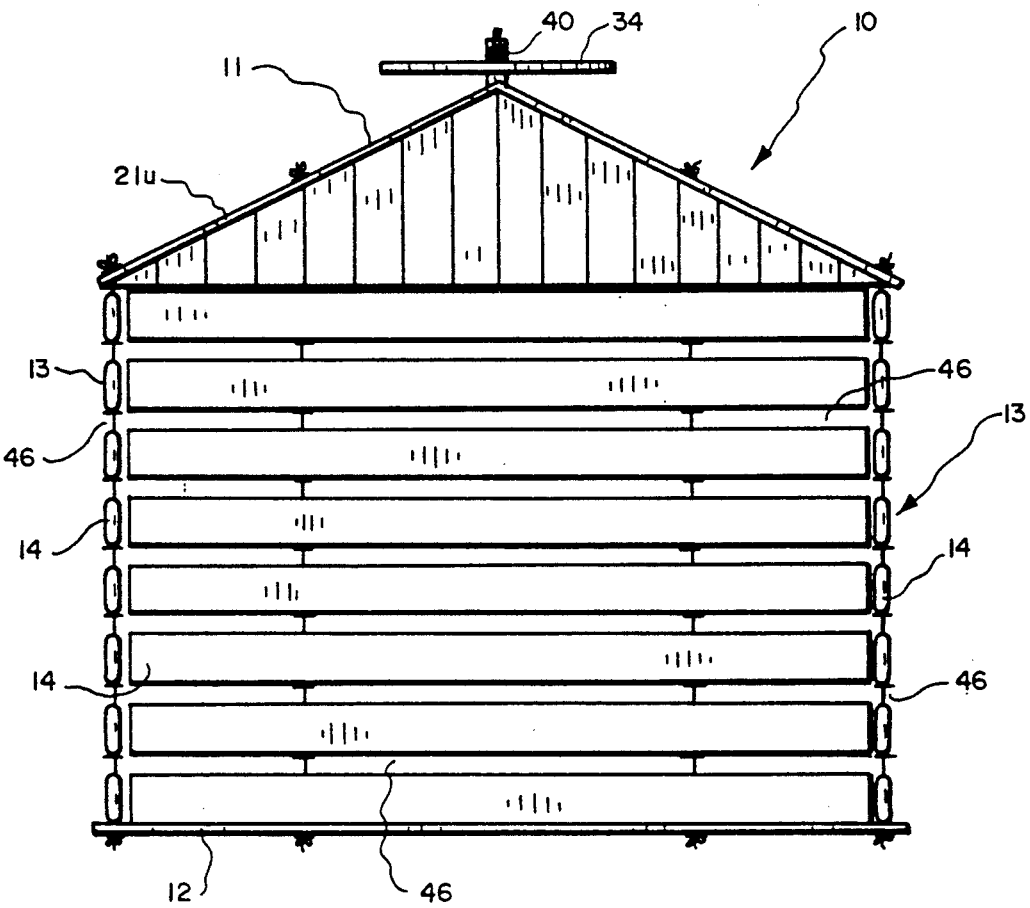
FIG. 1 is a side elevation view of a collapsible toy building in accordance with the invention, drawn to a somewhat reduced scale, FIG. 2 a top plan view of the collapsible building of FIG. 1, drawn to the same scale, partially cut away, FIG. 3 a vertical cross sectional view of fragments of the structure of FIGS. 1 and 2, taken along line 3—3 of FIG. 2, drawn to a somewhat larger scale, FIG. 4 a fragment of the collapsible column of the collapsible structure of FIG. 1, drawn in the collapsed state, and cross sectioned to show internal bores, cord and stiffening sleeves thereabout, drawn to approximately the scale of FIG. 3, FIG. 5 a view of a fragment of one of the collapsible walls of the building of FIG. 3, the planks thereof being shown in collapsed condition partially cross sectioned to illustrate internal bores and retaining cords passing therethrough, drawn to the scale of FIG. 4, FIG. 6 a fragment of the cross section fragments of FIG. 3, the cord retaining dogs however being shown in cord releasing position spread apart by the downwardly forced plunger, drawn to the same scale as FIG. 3, FIG. 7 a view of the collapsed house of FIG. 1 shown in collapsed condition, drawn to the same scale, FIG. 8 an illustration of the use of several of the houses of FIG. 1 under attack by a toy projectile launcher, drawn to a reduced scale, and FIG. 9 a cross sectional view of one of the segment-to-segment junctures of the column assembly of FIG. 3, showing the cord stiffening sleeve in cross section, drawn to a larger scale.
Figure 2:
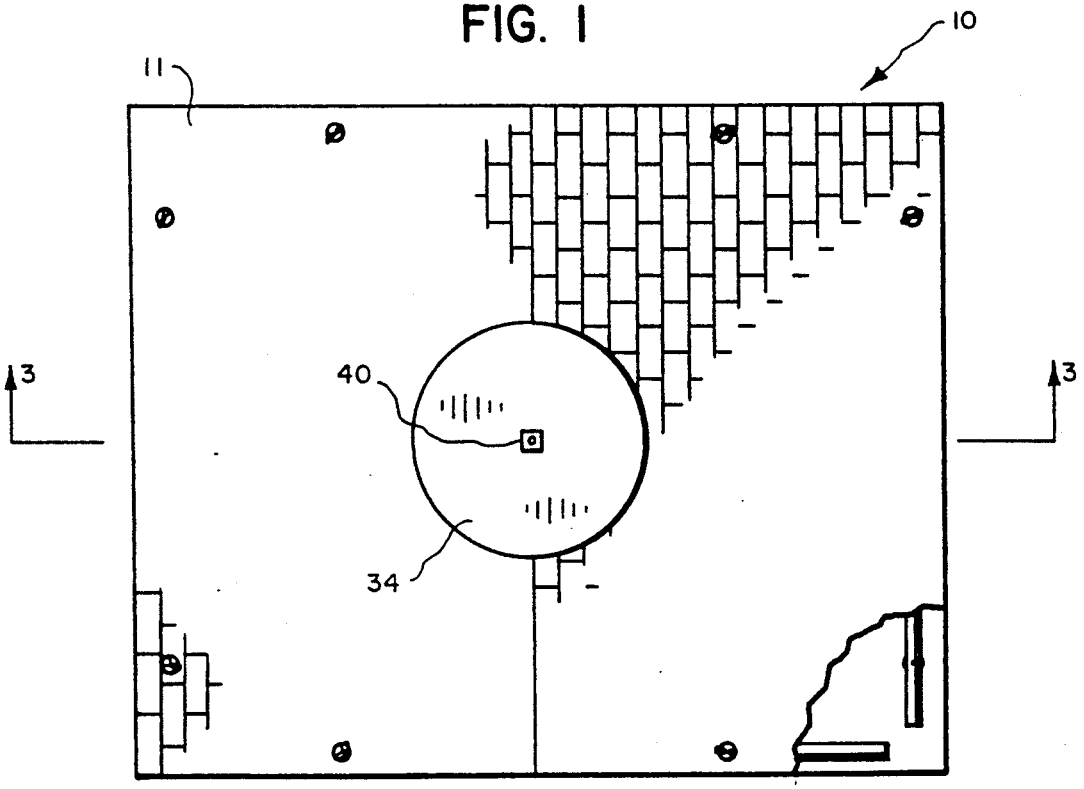
Figure 9:
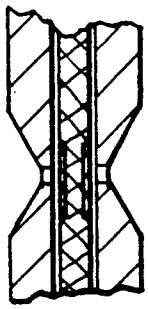
Figure 3:
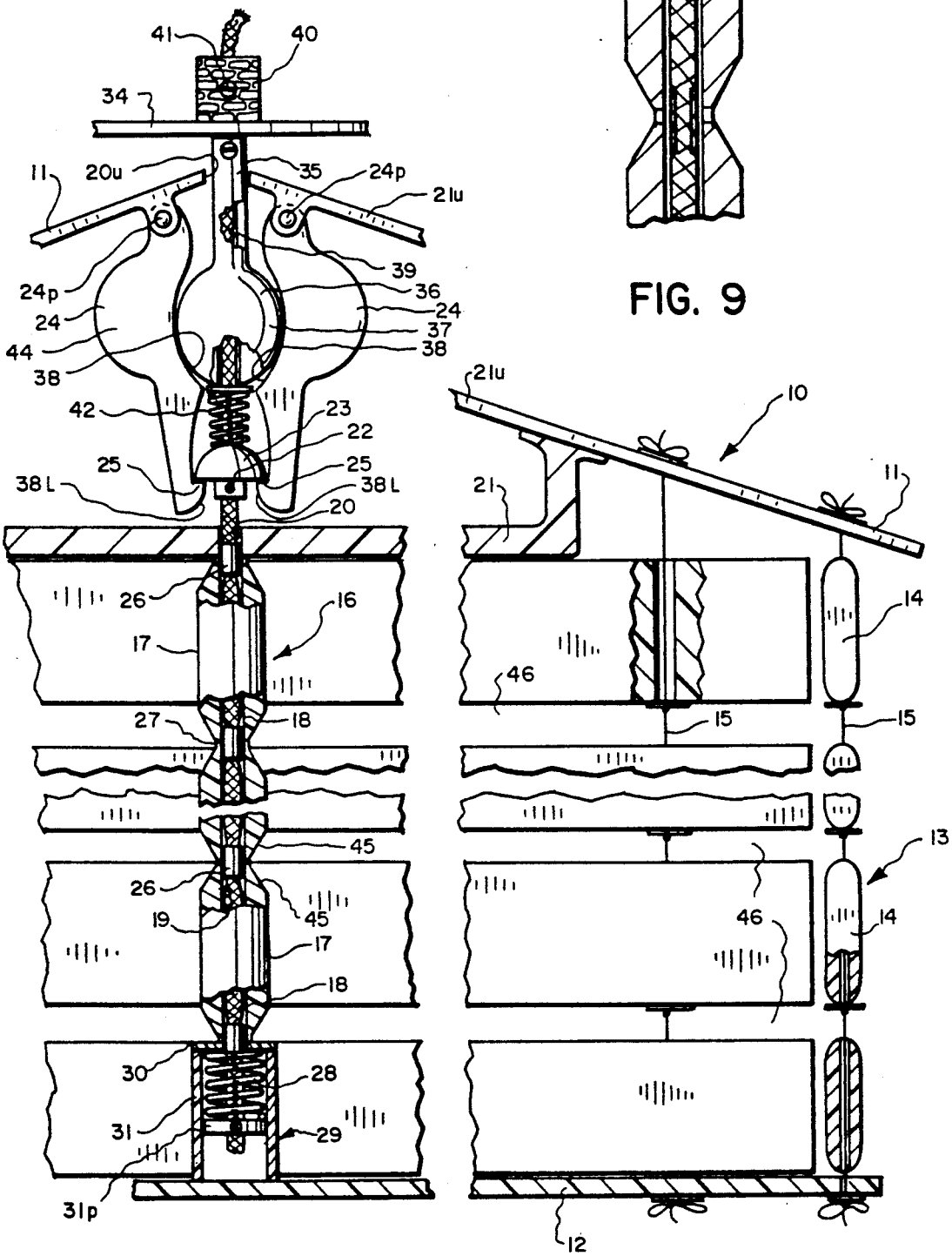
Figure 6:
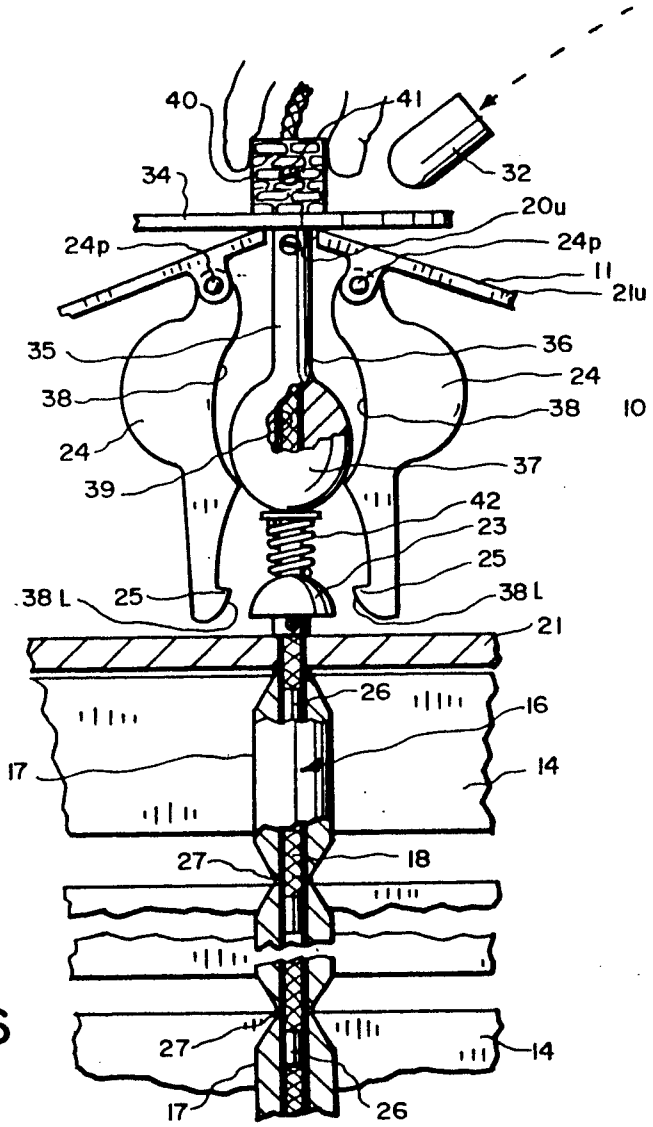

A collapsible toy house 10 in accordance with the invention is shown assembled erect in FIGS. 1 and 2. House 10 comprises a roof structure 11, a lowermost floor plate member 12 and wall assemblies 13 comprising simulated planks 14 each strung vertically separated upon cords 15. Roof 11 is supported above floor 12 by a central vertical column assembly 16. (FIGS. 3–6, 9) Column 16 comprises a multiplicity of separate column segments 17 held together by a tensioned flexible cord 18 strung through vertical central bores 19. Cord 18 passes through a bore 20 in lower roof support structure 21 to be attached to a button 23 by a set screw 22. Button 23 is engaged by a pair of dogs 24 by a lowermost hook 25 carried by each. Dogs 24, part of a disassembly triggering mechanism described in detail below, are suspended by pivot pins 24*p*.

When collapsible house 10 is in erect, stable, assembled condition, column assembly 16 is maintained rigid by stiff sleeves 26 secured at intervals along cord 18, positioned across each juncture 27 of column segments 17. Cord 18 is tensioned by a spring 28 in a housing 29 projecting upwardly from floor plate 12. Spring 28 is compressed between an upper cap plate 30 secured to housing walls 31 and a lower, cord-attached, plate 31*p*. Additional sleeves 26 may be employed at the junctures of segment 17 with roof member 20 and cap plate 30.

Figure 5:
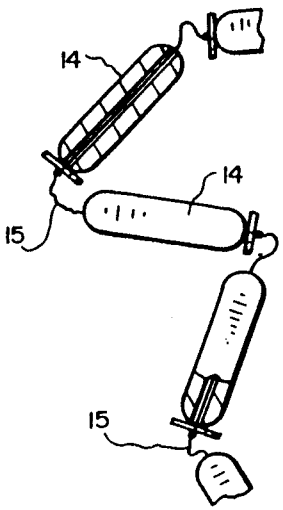
Figure 4:
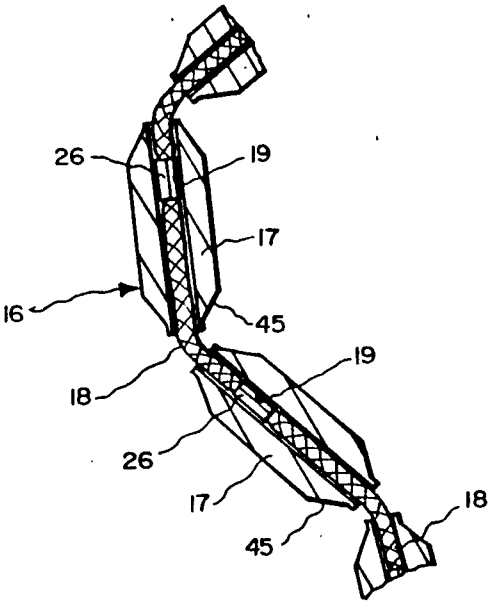
Figure 7:
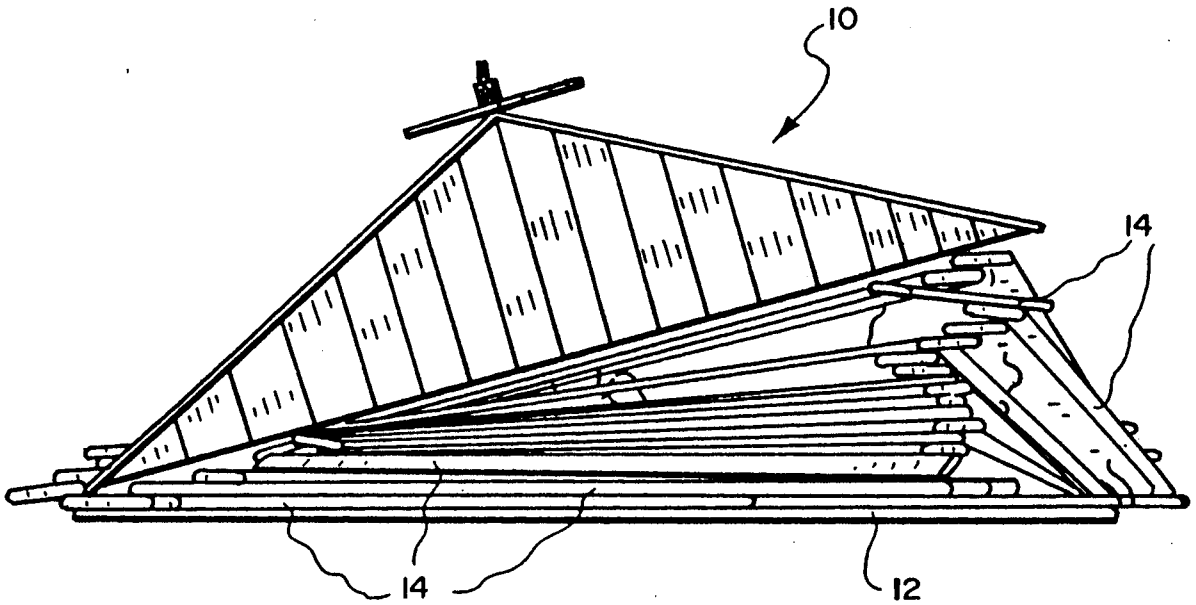
Figure 8:
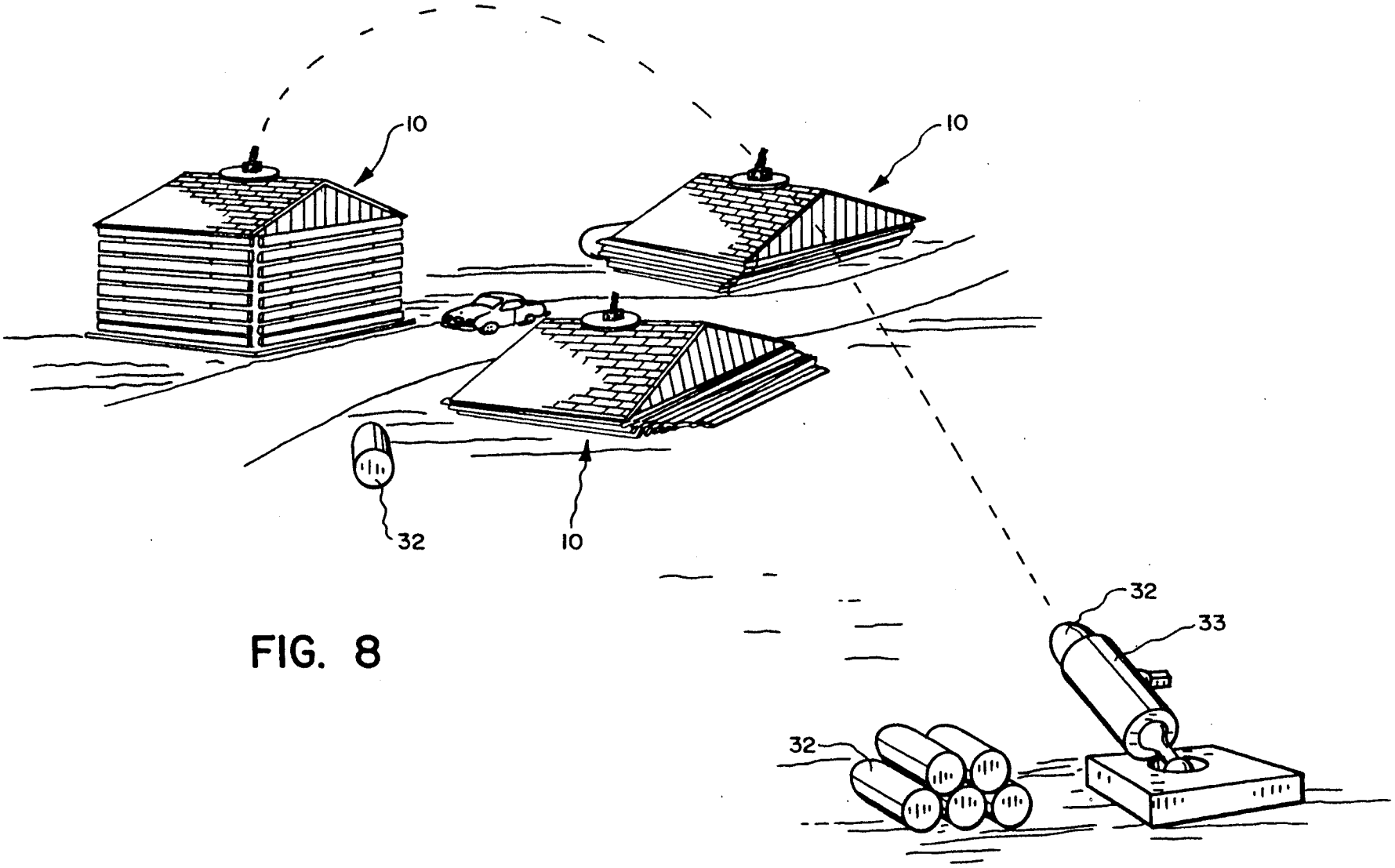

Upon release of upper button 23 from hooks 25, cord 18 is forced downward by expanding spring 28, shifting each rigid sleeve 26 to a point below its associated column segment junction 27, and its roof-segment and cap plate-segment junctions. (FIG. 6) This causes now unstable column assembly 16 to buckle leading to collapse of the entire house, as both column and walls collapse as indicated in FIGS. 4 and 5 respectively. The resulting collapsed house 10 is seen in FIG. 7. FIG. 8 shows several such collapsed houses 10, albeit more distantly.

Collapse of house 10 is triggered, for example, by impact of projectiles 32, such as from toy rocket launcher 33 (FIG. 8), upon release trigger plate 34 above roof 11. Impact plate 34 is secured against the uppermost end of a stem 35 of a triggering plunger 36 with bulbous lower end 37. (FIGS. 3 and 6) Stem 35 passes clearingly through an enlarged bore 20*u* in an uppermost roof member 21*u*. As plunger 35 is impacted downward, bulb 36 acts against upwardly diverging curved surfaces 38, forcing dogs 24 to pivot apart (FIG. 6), and disengaging hooks 25 from button 23. As previously described, cord 18 is then drawn down by spring 28 to shift the column stiffening sleeves 26 away from their structure stabilizing positions, causing column buckling and house collapse.

Preferably, column cord 18 extends upwardly through button 23 and through a plunger bore 39 and aligned bores, not shown, in impact plate 34 and simulated chimney 40, to which it is attached as by a set screw 41. Plunger, impact plate, and chimney are together supported by a very light upper spring 42 bearing upon the upper surface of button 23, which easily deflects to allow the plunger to operate as described above.

To restore the collapsed house to erect, column supported condition, it is only necessary to lift the still connected house 10 by grasping chimney 40 between thumb and fingers. (FIGS. 6) The weight of the house then compresses lower spring 28, lifting button 23 to first pivot dogs 24 apart by contact with lower, downwardly diverging surfaces 38 *l*, and then allowing the dogs to swing together to re-engage hooks 25. At the same time, all stiffening sleeves 26 are shifted to again span the column junctures 27, restoring column assembly 16 to rigid, house-supporting, condition. Collapsed walls 13 are also restored by lifting of plank cords 15.

Counter-balancing lobes 44 assure proper operation of the pivoting dogs. Cord 18 must be highly flexible, and also highly inelastic, to avoid undue stretching. Advisedly, column cord, the bores, the stiffening sleeves, and the column segment bores may be lubricated, as by graphite or the like. Column segments 17 are desirably shaped with beveled ends 45, to minimize required slack in cord 18 to permit collapse. (FIG. 5)

Wall planks 14 are suspended with separating spaces 46, assuring virtually complete collapse without binding. Plank ends at the house corners are separated to further prevent binding. (FIG. 2) Planks 14 randomly rotate and translate relatively, so that building 10 collapses into unpredictable configurations.

FIG. 8 illustrates a number of collapsed houses set up as a simulated village under attack by a toy rocket launcher 33.

Although the described and illustrated embodiment represents the best mode of carrying out the invention, various changes are possible without departing from the spirit of the invention. For example, column cord 18 could be secured to the bottom of plunger 36, instead of extending to above the roof, impact plate 34 then being lifted for house reassembly. Also, other mechanised impact released cord securing arrangements may be well within the spirit of the invention.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

What is claimed and desired to be secured by United States Letters Patent is:

1. A toy simulated collapsible building actuated by impact of a toy projectile, comprising:

a base;

a vertical column member upstanding from the base;

a simulated roof structure having outside edges and supported by the column member upwardly from the base; wherein the column member comprises at least two elongate segments stacked vertically end upon end from the base to the roof structure, each column segment having a central vertical bore therethrough;

a generally flexible cord installed passing sequentially through the segment bores, secured to the base through spring means urging the cord downwardly, and to the roof structure through releasable, reattachable, cord securing means opposing downward movement thereof;

means permitting lifting force to be exerted from above the roof upon the upper end of the column cord;

stiffening means carried by the cord at least at each segment-to-segment interface, substantially preventing relative rotation of the abutting segments out of vertical alignment;

impact actuated means releasing the cord securing means at the roof structure so that the cord is urged downwardly within the segment bores by the spring means at the base of the cord, simultaneously shifting the cord stiffening means downwardly away from all column segment interfaces, so that the column segments may rotate relatively out of vertical alignment at each interface, leading to instability of the column and building collapse; wherein the cord remains threaded through the segment bores and connected to the roof structure during and after building collapse, so that the building may be re-erected by applying lifting force upon the cord from above the roof structure, and reattaching the cord to the cord securing means at the roof structure.

2. The collapsible building of claim 1, wherein:

the cord is automatically reattached to the securing means at the roof when the collapsed building is re-erected.

3. The collapsible building of claim 1, having at least one collapsible wall structure comprising:

at least two simulated planks suspended in horizontal position from the roof structure, with at least two sets of aligned vertical bores therethrough; and a plank suspending cord assembly placed vertically through each of the sets of aligned bores and secured at its uppermost end to the roof structure.

4. The collapsible building of claim 2, having at least one collapsible wall structure comprising:

at least two simulated planks suspended in horizontal position from the roof structure, with at least two sets of aligned vertical bores therethrough; and a plank suspending cord assembly placed vertically through each of the sets of aligned bores and secured at its uppermost end to the roof structure.

5. The collapsible building of claim 4, wherein the roof structure has an uppermost member and a lowermost member secured thereto defining a vertical space between, the column cord extending into said space through a bore in the lowermost member, the cord securing means at the roof comprising:

a button fastened immovably to the column cord in the vertical space;

a pair of opposing hook-carrying members on opposite sides of the column cord, pivotally suspended from the uppermost roof member from their uppermost ends, and having opposing hooks at their lowermost ends engaging the button, and having opposing upwardly diverging surfaces above the button and opposing downwardly diverging surfaces below the hooks; wherein the impact actuated cord-releasing means comprises;

an elongate vertical plunger disposed between the hook-carrying members, spaced upwardly from the button, joining the column cord and extending upwardly through a bore through the uppermost roof member to join a horizontal impact plate spaced vertically thereabove, so that the plunger, upon downward impact of an object upon the plate, is forced downward with a lowermost portion thereof pivoting the hook-carrying members apart by contact with the opposing surfaces thereof above the button, and so that the button and the cord are released, causing building collapse, and so that upon application of lifting force to the cord from above the roof structure, the button pivots the hook-carrying members apart by contact with said diverging surfaces below the hook, re-engaging the hooks to the button, and re-erecting the building for reuse.

6. The collapsible building of claim 5, wherein:

the cord extends upwardly through the plunger and the impact plate by way of aligned central vertical bores through each, so that the cord may be grasped above the roof structure; and the impact plate is held in position vertically spaced from the roof structure by a spring bearing upon the top of the button and the bottom of the plunger, said spring being compressed by the impact of the object upon the impact plate, allowing the plunger to move downward to pivot the hook-carrying members apart.

* * * * *